US005848850A

United States Patent [19]

Bontoux et al.

[11] Patent Number: 5,848,850

[45] Date of Patent: Dec. 15, 1998

[54] VARIABLE WIDTH WAX APPLICATOR ROLLER AND DEPILATORY WAX APPLICATOR HAVING SUCH ROLLER

[75] Inventors: Daniel Bontoux, Saint Genis Laval; Elisabeth Lextrait, Limas, both of France

[73] Assignee: SEB S.A., Ecully, France

[21] Appl. No.: 747,720

[22] Filed: Nov. 8, 1996

[30] Foreign Application Priority Data

Nov. 8, 1995 [FR] France ..... 95 13439

[51] Int. Cl.[6] ..... A45D 40/26; A45D 26/00

[52] U.S. Cl. ..... 401/1; 401/197; 401/208; 401/219; 401/220

[58] Field of Search ..... 401/1, 2, 208, 401/219, 220, 197

[56] References Cited

U.S. PATENT DOCUMENTS

| | | | |
|---|---|---|---|
| 4,143,668 | 3/1979 | Duval et al. | 401/208 |
| 4,773,784 | 9/1988 | Mann . | |
| 5,564,851 | 10/1996 | Connelly et al. | 401/208 X |

FOREIGN PATENT DOCUMENTS

| | | | |
|---|---|---|---|
| A-0368698 | 5/1990 | European Pat. Off. . | |
| 1003948 | 3/1952 | France | 401/208 |
| A-2520601 | 8/1983 | France . | |
| 463052 | 2/1927 | Germany | 401/1 |
| A-2948886 | 6/1981 | Germany . | |

*Primary Examiner*—Steven A. Bratlie
*Attorney, Agent, or Firm*—Pillsbury Madison & Sutro

[57] ABSTRACT

Applicator roller for a thermoplastic depilatory wax, the roller being mountable in a wax applicator assembly. The roller includes a wax applicator member and a control device associated with the wax applicator member and operable for causing the wax applicator member to selectively deposit on the skin of a user a band of wax having any one of a plurality of different widths.

An applicator for a thermoplastic depilatory wax, the applicator being configured to be held in the hand of a user and including a reservoir for storing a mass of wax, a component for heating the wax and the applicator roller described above.

12 Claims, 1 Drawing Sheet

VARIABLE WIDTH WAX APPLICATOR ROLLER AND DEPILATORY WAX APPLICATOR HAVING SUCH ROLLER

BACKGROUND OF THE INVENTION

The present invention relates to the general technical field of devices for applying thermoplastic products, and particularly devices for applying depilatory wax, these devices being adopted to store the wax in solid form at room temperature, while being capable of altering its state and causing it pass into a liquid, or at least pasty or semi-liquid, in order to permit it to be applied with the aid of a roller.

The present invention concerns particularly an applicator roller for a thermoplastic depilatory wax intended to be functionally associated with a wax applicator assembly that includes a housing associated with a holding means and a reservoir for the product to be applied, the reservoir being in thermal communication with heating means.

The present invention equally concerns an assembly for applying wax which comprises the applicator itself, as well as the applicator roller according to the invention.

Techniques for depilation by the application of a depilatory wax with the aid of a roller are already known in the art, as disclosed, for example, in French Patent No. 2520601. In a general manner, this technique consists in melting a certain quantity of wax which is found in a substantially solid state at room temperature, then applying the wax, in its melted or softened state, in the form of a layer on the area to be depilated.

After hardening, i.e. after cooling, the cold wax layer or film is withdrawn with the aid of appropriate means which vary depending on the hair removal technique utilized.

By way of example, the removal, or lifting, of the wax layer, or band, can be effectuated directly in a manual manner if the wax possesses the necessary elasticity characteristics, or indirectly with the aid of supplemental means, such as a sheet of fabric or a piece of paper.

When the wax is withdrawn, hairs are pulled out of the skin because of their attachment to the wax.

Conventional wax applicators include a housing intended to be held in the hand, as well as a reservoir intended to store the wax, the housing comprising heating means in thermo-communication with the reservoir to heat the wax to its melting temperature, in order to cause it to undergo a change in state.

Conventional appliances also include applicator means which can be present in the form of various tips, or nozzles, or even rollers. In certain wax applicators, the heating means are independent of the housing, as disclosed in French Patent No. 2520601, and are mounted in a base which provides a heating element.

In the particular application of thermoplastic depilatory wax which relates directly to the invention, which is the application of depilatory wax by the intermediary of applicator rollers, European Application A0368698 describes a manual applicator including in the same housing, a wax reservoir, a heating resistance and an applicator roller. Such a structure is also disclosed in U.S. Pat. No. 5556468.

When the wax applicator is inverted, so that the roller is at a lower elevation than the reservoir, wax is applied in a fluid state to the skin with the aid of gravity as the roller, which directs and spreads the wax in a thin and controlled layer, is applied to the skin.

Appliances of this type generally provide over all satisfaction, and are particularly utilized to apply the wax in small quantities for depilating the legs.

Applicators of this type nevertheless suffer from a major drawback connected with the difficulty, or even the impossibility, of easily depositing bands or strips of wax in different regions of the body, such as the arm pits, above the upper lip, certain regions where the skin presents folds, etc. This is due in large measure to the impossibility of varying, and in particular of reducing, the width of the band of wax applied by the roller.

Presently, the only appliances permitting, under certain conditions, the application of wax bands having different widths all rely on the principle of a simple replacement of an accessory, or even by a complete exchange of applicators to allow use of another applicator equipped with a roller whose rolling surface has a different width. This is disclosed, for example, in French Patent No. 2520601.

Solutions relying on a simple exchange of accessories present the drawback which one precisely seeks to avoid in the case of depilatory wax appliances, which is an increase in the time required to perform the depilatory treatment, since it is then necessary for the new wax container or the new applicator to be ready, as well as an increase in the number of manipulations because it is necessary to remove the wax container, clean it, store it and install a new container and a new accessory.

SUMMARY OF THE INVENTION

It is a primary object of the present invention to resolve the totality of the drawbacks noted above, and in particular to provide a depilatory wax applicator roller capable of applying wax bands having a variable width in a manner which the user will find to be simple and rapid.

Another object of the invention is to provide an applicator roller and an associated appliance which permits achievement of numerous possibilities for varying the width of the area over which wax is applied, while being of a simple structure.

A further object of the invention is to provide a wax applicator roller and appliance associated therewith which is able to assure or facilitate the passage of a band of wax having a width which is selected in a reliable and rapid manner.

The above and other objects are achieved, according to the present invention, by an applicator roller for a thermoplastic depilatory wax, the roller being mountable in association with a wax applicator assembly, wherein the roller comprises wax applicator means, and control means associated with the wax applicator means and operable for causing the wax applicator means to selectively deposit on the skin of a user a band of wax having any one of a plurality of different widths.

The objects according to the invention are also achieved with the aid of an applicator for a thermoplastic depilatory wax intended to be held by or in the hand, and comprising a means for storing amounts of wax and a means for heating the wax, as well as a wax applicator roller having the structure disclosed above.

Various other characteristics will become more readily apparent from the following description, presented with reference to the attached drawings which show, by way of non-limiting examples, embodiments of the invention.

DESCRIPTION OF THE PREFERRED EMBODIMENTS

Figure 1:
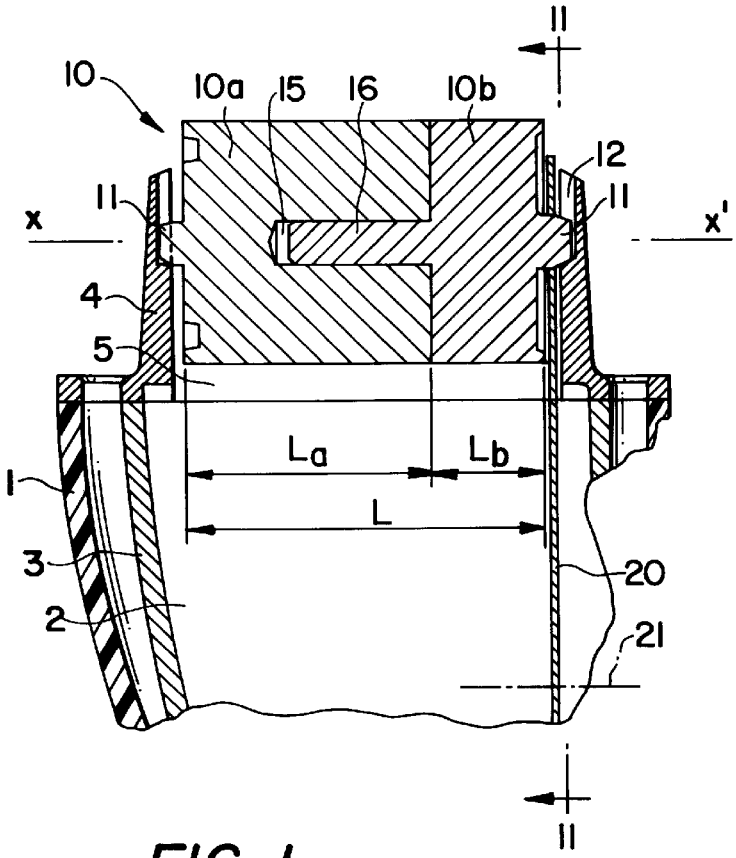
FIG. 1 is a cross-sectional detail view in a longitudinal plane showing an applicator roller according to the invention installed in a wax applicator appliance corresponding to a first embodiment of the invention.

The applicator for thermoplastic products as shown in FIG. 1 comprises, in a conventional manner, an exterior housing 1, made, for example, of a plastic material presenting, in a non-limiting manner, a generally elongated form which permits it to be easily held by or in the hand of a user. Housing 1 can have any external configuration which is suitable for this purpose.

At the interior of housing 1 there is disposed a reservoir 2 which is delimited toward the outside by a wall 3 generally made of a material which is a good conductor of heat and which is for example, of metal.

Reservoir 2 thus forms the means for storing wax, or more generally, a thermoplastic product to be applied.

Advantageously, wall 3 of reservoir 2 is made of aluminum and advantageously extends along the entire central part of housing 1 while being limited at its lower part by a base (not shown) and at its upper part by a metal head 4, possibly connected or screwed onto wall 3.

Metal head 4 delimits towards the inside an upper opening for the applicator forming a conduit or channel 5 which permits the wax to flow under the force of gravity from reservoir 2 toward the outside.

In a manner known per se, the appliance for applying wax according to the invention includes heating means (not shown), housed and fixed within housing 1, preferably in its lower portion and in thermocommunication with the wall or walls 3. The heating means can be constituted by any conventional electrical element capable of converting a high-voltage or low-voltage current into thermoenergy for melting the wax.

By way of a non-limiting example, the heating means can be constituted by an electric resistance or a positive temperature coefficient of resistance element, surrounding, for example, at least partially, the reservoir 2. The heating means are equally, as is well-known in the prior art, associated with heat regulation means, such as a thermostat and a fuse (not shown).

The wax applicator roller 10 according to the invention, having an axis of rotation x–x', is disposed in the channel 5 and rests, for example, on lateral bearings II in recesses 12 formed in the walls of head 4. Applicator roller 10 is supported in the recesses 12 and is mounted to rotate freely around its axis x–x'. Bearings II present rotation axes which are aligned with the longitudinal axis x–x'.

Applicator roller 10 is made, for example, of a metal material provided at its peripheral surface with a coating of a plastic material, advantageously overmolded and forming the wax application layer. One example of a roller having a plastic coating layer over a metal core is described in the above-cited U.S. Pat. No. 5,556,468.

Applicator roller 10 comprises mink wax applying means which are capable of assuring, in a selective manner by control means, the depositing on the skin of bands of wax having different widths, depending on the selection effectuated.

Figure 2:
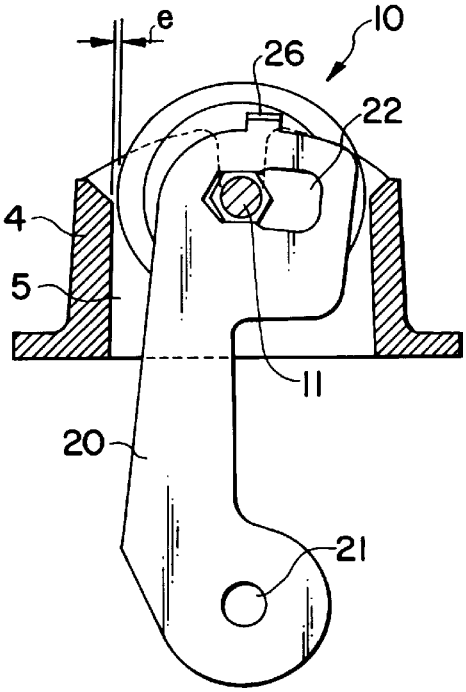
FIG. 2 is a cross-sectional view taken along line II—II of FIG. 1 showing a portion of the appliance according to the first embodiment, with the roller according to the invention being in a position in which its rotation is blocked.
Figure 3:
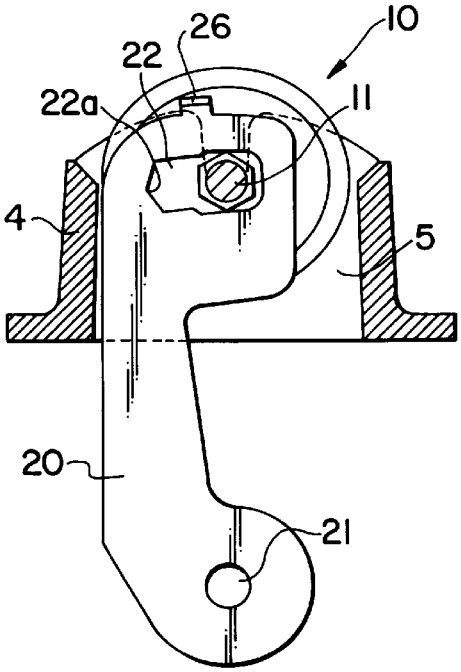
FIG. 3 is a view similar to that of FIG. 2 showing the appliance in a position in which the roller is free to rotate.

For this purpose, the application means comprise, as shown in FIGS. 1–3, at least two cylinders 10*a*, 10*b*, which are disposed adjacent one another and which together form the roller 10. At least one of the cylinders is capable of being selectively blocked so that it is prevented from rotating, or free to rotate, by the intermediary of control means.

As shown in FIG. 1, cylinders 10*a* and 10*b* are coaxial, have identical diameters and are disposed side-by-side. Cylinders 10*a* and 10*b* are preferably mounted so that a portion of one cylinder is housed within the other cylinder so that the two cylinders together form a single applicator roller 10. Thus, cylinder 10*a* is provided, for example, along the axis of rotation with a blind bore 15 in which is slidably mounted a male part 16 which is fixed to cylinder 10*b*. The dimensional relations between bore 15 and male part 16 are such that bore 15 forms a bearing for the male part 16. Thus, cylinders 10*a* and 10*b* can be placed in rotation at the same speed when roller 10 is rolled on the skin. In the same manner, when one of the cylinders is blocked against rotation, the other cylinder can be placed into rotation when the roller rolls on the skin.

According to a preferred form of construction of the invention, cylinders 10*a* and 10*b* are preferably two in number but a larger number of cylinders can also be disposed in a side-by-side arrangement.

According to another preferred form of construction of the invention, each cylinder 10*a* and 10*b* has a rolling band with a specific application width which is different from the width of the other cylinder in such a manner as to be able to apply bands of wax having corresponding and respectively different widths.

Thus, cylinder 10*a* (FIG. 1) has a width La which is greater than the width Lb of cylinder 10*b*, the sum La +Lb or forming the corresponding width L of the applicator roller 10. Each cylinder 10*a* and 10*b* can apply a band of wax having a width equal to the width of the cylinder itself.

The control means comprise a means for blocking the application means, i.e. cylinders 10*a* and 10*b*, against rotation. Preferably, the blocking means are mechanical blocking means including a control means such as an arm 20 pivotally mounted in the vicinity of a lateral face of a cylinder 10*a* or 10*b* on the applicator assembly. Arm 20 is mounted to pivot about an axis 21 between a position for disengaging the rotational axis x–x' (FIG. 3) and a position for engaging this same rotational axis (FIG. 2).

Arm 20 has at its upper portion a housing 22 defining an opening having a profile which includes a portion that is complementary to a portion of one of bearing 11. By way of non-limiting example, arm 20 is mounted in the vicinity of cylinder 10*b* and opening 22 has a substantially oblong form. One end 22*a* of opening 22 has a partially hexagonal profile which is dimensioned so that when arm 20 is in its engagement, or blocking position, as shown in FIG. 2, terminal part 22*a* engages with a hexagonal part of applicator roller 10. Preferably, the hexagonal part is formed by a part of the associated bearing II in a manner to prevent rotation of cylinder 10*b*. In such a state, when applicator roller 10 is rolled along the skin, only cylinder 10*a* can rotate to permit application of a band of wax having a width La. Inversely, when arm 20 is in the disengagement position in FIG. 3 both cylinders 10*a* and 10*b* will rotate in unison on the skin in order to apply a wax layer, or band, having a width L.

According to a variation of the embodiment described above, it is possible to provide two arms 20 and to associate each arm with a respective cylinder 10*a*, 10*b*, or more specifically with the bearing II associated with a respective cylinder, in order to be able to selectively control a blockage of either of cylinders 10*a* and 10*b* against rotation. In this case, applicator roller 10 can be controlled to selectively apply a wax band having any selected one of three different widths. In the above-described embodiments, arm 20, or each arm 20, is provided at its upper end with a lug 26 via which the user can move the arm to either one of its operating positions.

In a particularly advantageous manner, the gap "e" shown in FIG. 2, defined between the rolling surface of applicator roller 10 and the internal wall of head 4 is substantially equal to 0.5 millimeter and preferably between 0.4 millimeter and 1 millimeter. If the dimension of gap "e" is maintained within this range, wax is prevented from flowing out when roller 10 is not rotating.

The operation of an applicator roller according to the invention is the following. The user selects, with the aid of control means 20, 26, the desired wax band width by selecting to selectively block one or the other of cylinders 10*a,* 10*b,* or to not block any of the cylinders. The user thus may have available any one of there desired widths for the wax band. The selection having been performed, the user will invert the applicator and apply wax to the area to be depilated by rolling the roller over that area.

It is thus possible for the user to select, depending on the area to be depilated, any one of the available widths for the wax band, by performing a particularly simple manipulation.

According to other embodiments of the invention, it is possible to utilize in place of a mechanical blocking means any other type of equivalent blocking means, such as those utilizing magnetic forces produced by a permanent magnet or an electromagnet.

According to another embodiment of the invention, each cylinder 10*a,* 10*b* could be mounted, rather than on a common shaft, on two separate, neutrally-aligned shafts when the cylinders 10*a,* 10*b* are in position at the bottom of channel 5. Cylinders 10*a,* 10*b* are disposed side-by-side at the bottom of channel 5 and impede the escape of wax. Each cylinder 10*a,* 10*b* can be mounted on head 4 in a manner to slide and occupy an upper work position in which wax can flow out. This embodiment thus permits selection of several widths for the wax band by selecting the raised position of the cylinder or cylinders 10*a,* 10*b* that one desires to utilize and to cause to rotate on the skin.

Figure 4:
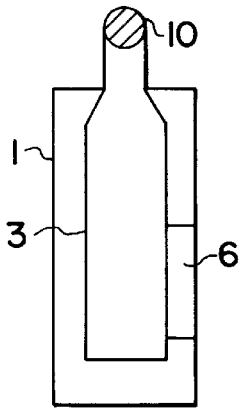
FIG. 4 is a simplified, cross-sectional side view of an applicator equipped with a roller according to the present invention.

An applicator roller according to the invention, as shown in FIGS. 1–3, will typically be installed in an applicator of the general type shown in FIG. 4. This applicator includes, in addition to housing 1 and reservoir 2, which are also shown in FIG. 1, heating means 6 for heating the wax stored in reservoir 2 in order to melt the wax. Heating means 6 may include a conventional heating resistor, along with a temperature controller, a safety fuse and a power cord (not shown) for connecting the heating means to a wall outlet.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. Applicator roller for a thermoplastic depilatory wax, said roller being mountable in association with a wax applicator assembly, wherein said roller comprises wax applicator means, and control means associated with said wax applicator means and operable for causing said wax applicator means to selectively deposit on the skin of a user a band of wax having any one of a plurality of different widths.

2. A roller according to claim 1 wherein said wax applicator means comprise at least two cylinders disposed adjacent one another and together forming said applicator roller, at least one of said cylinders being coupled to said control means to be selectively blocked against rotation or to rotate freely in response to operation of said control means.

3. Roller according to claim 2 wherein said cylinders are coaxial with, and have the same outer diameter as, one another.

4. Roller according to claim 3 wherein one of said cylinders has a portion which is housed in a recess in another one of the cylinders.

5. Roller according to claim 2 wherein each cylinder has an external rolling surface with a respective width and the width of the rolling surface of each of said cylinders is different from that of each other one of said cylinders.

6. A roller according to claim 1 wherein said control means comprise mechanical means for preventing rotation of at least part of said wax applicator means.

7. A roller according to claim 2 wherein said means for preventing rotation are mechanical blocking means mounted for pivoting movement between a disengagement position and an engagement position for preventing rotation of at least one of said cylinders.

8. Roller according to claim 7 wherein said blocking means comprise an arm pivotally mounted on the wax applicator assembly and said arm has an opening formed to have a profile which corresponds to a profile of a portion of a shaft of said roller in a manner to be able to block the shaft in the engagement position.

9. An applicator for a thermoplastic depilatory wax, said applicator being configured to be held in the hand of a user and comprising means for storing a mass of wax, means for heating the wax and the applicator roller as defined in claim 1.

10. Applicator according to claim 9 further comprising a housing having walls defining an outlet channel for flow of wax, and wherein said roller is disposed at least partially in said channel and includes an outer surface for applying a layer of wax to the skin of the user, and said outer surface is spaced from the walls of said housing by a distance sufficient to prevent wax from flowing under the influence of gravity out of said channel when said roller is not rotating.

11. Applicator according to claim 10 wherein the distance is substantially equal to 0.5 millimeters.

12. Applicator according to claim 11 wherein the distance is between 0.4 millimeter and 1 millimeter.

* * * * *